US007083003B1

(12) United States Patent
Pusateri et al.

(10) Patent No.: US 7,083,003 B1
(45) Date of Patent: Aug. 1, 2006

(54) POWER TOOL WITH DETACHABLE DRIVE END

(75) Inventors: Daniel S. Pusateri, Grayslake, IL (US); Thomas J. Zikowski, Racine, WI (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 10/195,998

(22) Filed: Jul. 15, 2002

Related U.S. Application Data

(63) Continuation-in-part of application No. 09/840,539, filed on Apr. 23, 2001, now abandoned.

(51) Int. Cl.
*B21J 7/02* (2006.01)

(52) U.S. Cl. ..... 173/29; 173/93.6; 173/213; 173/132; 279/145

(58) Field of Classification Search ..... 173/132, 173/93.6, 213, 29; 279/145 X, 143, 144, 279/145; 408/124, 19.5
See application file for complete search history.

(56) References Cited

U.S. PATENT DOCUMENTS

| | | | | |
|---|---|---|---|---|
| 2,147,163 | A * | 2/1939 | Jimerson | 411/548 |
| 2,539,003 | A | 1/1951 | Agustoni | |
| 2,822,677 | A | 2/1958 | Reynolds | |
| 3,270,593 | A | 9/1966 | Kaman | |
| 3,363,699 | A | 1/1968 | Maffey, Jr. | |
| 3,592,087 | A | 7/1971 | Pauley | |
| 3,592,274 | A | 7/1971 | Young | |
| 3,734,515 | A | 5/1973 | Dudek | |
| 3,759,336 | A * | 9/1973 | Marcovitz et al. | 173/213 |
| 3,804,180 | A | 4/1974 | Gelfand et al. | |
| 3,972,376 | A | 8/1976 | Price | |
| 4,083,415 | A * | 4/1978 | Kita et al. | 173/132 |
| 4,266,453 | A * | 5/1981 | Farley | 81/177.85 |
| 4,480,511 | A * | 11/1984 | Nickipuck | 81/124.6 |
| 4,567,951 | A | 2/1986 | Febrle et al. | |
| 4,655,380 | A * | 4/1987 | Haytayan | 227/9 |
| 4,867,249 | A | 9/1989 | Watkins, Jr. et al. | |
| 5,330,206 | A | 7/1994 | Krumszyn et al. | |
| 5,458,206 | A | 10/1995 | Bourner et al. | |
| 5,624,000 | A | 4/1997 | Miller | |
| 5,667,330 | A | 9/1997 | Henkel et al. | |
| 5,678,961 | A | 10/1997 | Fleege et al. | |
| 5,740,892 | A * | 4/1998 | Huang | 192/43.1 |
| 5,855,069 | A * | 1/1999 | Matsubayashi et al. | 30/276 |
| 5,908,076 | A * | 6/1999 | Marcengill et al. | 173/93 |
| 6,000,888 | A | 12/1999 | Hartman | |
| 6,109,620 | A | 8/2000 | Roberts et al. | |
| 6,119,794 | A * | 9/2000 | Chen | 173/93 |
| 6,186,247 | B1 | 2/2001 | Wang | |
| 6,293,559 | B1 * | 9/2001 | Harman et al. | 279/75 |
| 6,321,855 | B1 * | 11/2001 | Barnes | 173/211 |
| 6,491,112 | B1 * | 12/2002 | Shin | 173/93.5 |

* cited by examiner

*Primary Examiner*—Scott A. Smith
*Assistant Examiner*—Brian Nash
(74) *Attorney, Agent, or Firm*—Seyfarth Shaw LLP

(57) ABSTRACT

A rotary tool includes a housing structure with a plurality of apertures therein, drive mechanism disposed within the housing structure, a detachable drive end mechanism coupled to the drive mechanism, and a retaining structure received by the apertures. The drive mechanism is coupled to the detachable drive end mechanism by a splined sleeve. The detachable drive end mechanism includes a detachable drive end and a collar which engages the retaining structure. Several embodiments of collars and retaining structure are disclosed. In one embodiment, the retaining structure includes a generally U-shaped flexible and resilient spring clip which is flexed when installed to frictionally hold itself and the drive end and collar in place.

28 Claims, 4 Drawing Sheets

POWER TOOL WITH DETACHABLE DRIVE END

REFERENCE TO RELATED APPLICATION

This application is a continuation-in-part of U.S. patent application Ser. No. 09/840,539, filed Apr. 23, 2001, now abandoned entitled "Impact Tool With Detachable Drive End."

BACKGROUND OF THE INVENTION

The subject matter of this application relates to power hand tools. More particularly this application relates to power hand tools of the rotary impact type.

There are a number of rotary impact tools in the prior art. These devices, which include impact wrenches, typically have an impact mechanism which generates a rotational movement by rapidly delivering a succession of rotational blows to a driven member. The driven member typically has a drive end which is detachably engageable with a socket or other tool.

While prior-art impact wrenches will generally work for their intended purpose, the high-torque applications in which these impact wrenches may be used and the frequency with which these tools are used often place high stress on the drive end. Consequently, the drive end, at times, may fracture or deform. Since the drive end is an integral part of the impact wrench, the impact wrench is effectively disabled without a functioning drive end. Consequently, the user is often left unable to complete a task when a drive end is broken.

Due to the complexity of the design of typical impact wrenches, repair of a disabled drive end is often only undertaken by manufacturer-trained technicians. In order to repair a drive end, the user must either send or deliver the broken impact wrench to the manufacturer or a repair center for repair, or else purchase a new impact wrench. The delay in repairing or replacing an impact wrench may significantly delay the completion of a task.

SUMMARY OF THE INVENTION

Generally, this application relates to an improved rotary power tool which avoids the disadvantages of prior tools while affording additional structural and operating advantages.

An important aspect is the provision of a rotary power tool which is of relatively simple design and economical structure.

Another important aspect is the provision of a rotary power tool with an easily removable drive end.

Another important aspect is the provision of a drive end that is easily detachable.

Yet another aspect is the provision of apparatus for effectively retaining a detachable drive end in place in the associated power tool.

In connection with the foregoing aspects, yet another aspect is the provision of a method of removing and replacing a drive end and retaining it in place.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
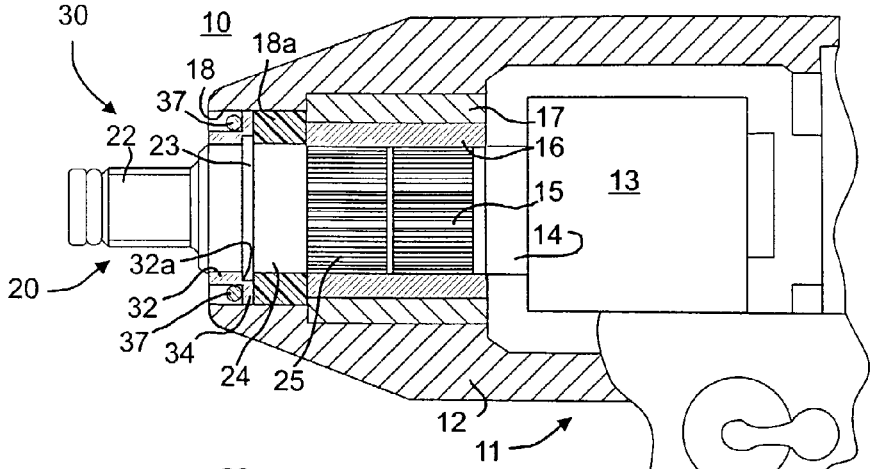
FIG. 1 is a fragmentary, sectional view of a rotary impact tool with a detachable drive end mechanism and retaining structure therefor.

Referring to FIG. 1, there is illustrated a rotary power tool in the form of an impact wrench 10 having a housing structure 11 which includes a housing 12, which may be formed of a suitable metal, or could be formed of a suitable plastic or composite material, and defines an internal cavity. Disposed within the housing 12 is a drive mechanism of known construction, which includes an impact mechanism 13, which is coupled to a motor (not shown), the impact mechanism 13 typically including a hammer (not shown) and an anvil 14. Typically the hammer is driven by the motor for delivering repeated rotational impacts to the anvil 14, all in a known manner, for intermittently rotating the anvil 14. The anvil 14 has a splined end 15 which is disposed within and in meshing engagement with the rear end of a splined sleeve 16, which is rotatably mounted within a bearing 17. The forward end of the housing 12 defines a cylindrical opening 18 into the cavity, in which is disposed an annular oil seal 18*a* which seats against the front ends of the splined sleeve 16 and the bearing 17. Formed laterally through the housing 12 adjacent to the front end thereof, are two apertures in the nature of cylindrical bores 19 which extend parallel to a diameter of the housing 12 on opposite sides thereof, intersecting the opening 18.

Figure 2:
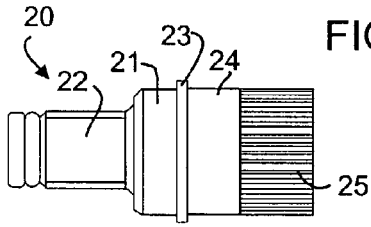
FIG. 2 is a reduced, side elevational view of the detachable drive end of the tool of FIG. 1.
Figure 4:
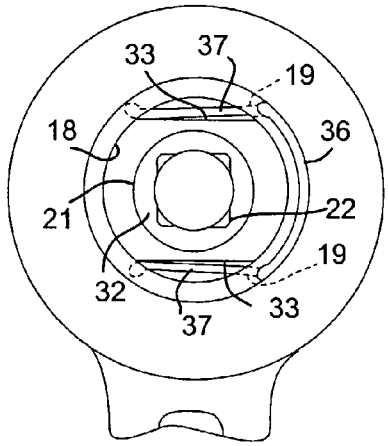
FIG. 4 is a front elevational view of the rotary impact tool in FIG. 1 showing interaction between the retaining structure and the detachable drive end mechanism.
Figure 5:
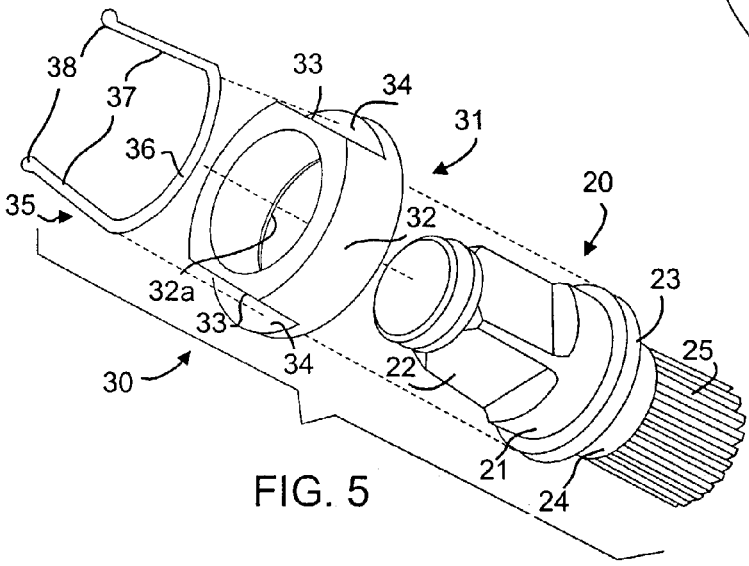
FIG. 5 is an enlarged, exploded, perspective view of the retaining structure and the detachable drive end mechanism of FIG. 1.

Referring also to FIGS. 2, 4, and 5, the rotary impact tool 10 includes a detachable drive end mechanism 30 which includes a drive end 20 which has a cylindrical body 21 with a drive square 22 projecting forwardly therefrom. Integral with the body 21 at the rear end thereof and extending laterally outwardly therefrom is an annular flange 23. Projecting rearwardly from the flange 23 is a reduced-diameter portion 24 provided at it's distal end with circumferentially spaced splines 25 designed for a mating engagement with the splines of the sleeve 16. In assembly, the splined end of the detachable drive end 20 is inserted into the housing opening 18, through the oil seal 18*a* and into meshing engagement in the front end of the splined sleeve 16, as can best be seen in FIG. 1, until the flange 23 seats against the oil seal 18*a*, which serves as a mechanical stop.

Figure 3:
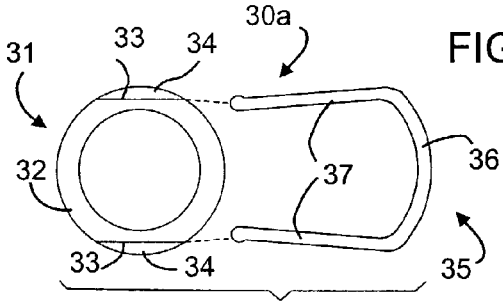
FIG. 3 is a front elevational view of a collar and a retaining clip of the tool of FIG. 1.

Referring also to FIG. 3, the detachable drive end mechanism includes an annular collar 31 having a cylindrical body 32. Formed in the outer surface of the body 32 at the front end thereof are two parallel flats 33 on opposite sides of the central axis and respectively defining co-planar shoulders 34 which lie in a plane perpendicular to the central axis. The collar 31 has an outer diameter slightly less than the diameter of the housing opening 18 and an inner diameter slightly greater than the outer diameter of the body 21 of the detachable drive end 20. In assembly, the collar 31 is fitted over the forward end of the detachable drive end 20 and seated against the flange 23 of the detachable drive end 20. In this regard, a suitable annular groove 32*a* may be formed in the rear end of the collar 31 to accommodate the flange 23 (see FIGS. 1 and 5).

Referring to FIGS. 3–5, the collar 31 forms part of a retaining structure 30*a*, which includes a clip 35 which may be formed of a flexible and resilient material, such as a spring steel or the like, having a bight 36 and a pair of legs 37 which converge slightly toward their distal ends, at which ends the legs are respectively provided with short outturned feet 38. In assembly, once the collar 31 has been installed in place, the legs 37 of the clip 35 are spread sufficiently to permit them to be respectively inserted into the lateral bores 19, so that the legs 37 respectively pass over the flats 33 of the collar 31 for engagement with the shoulders 34, until the bight 36 seats against the outer surface of housing 12 (see FIG. 4). The outturned feet 38 serve to frictionally hold the clip 35 in place in the lateral bores 19, the clip 35 retaining the collar 31, which in turn retains the detachable drive end 20. For removal of the detachable drive end 20, the clip 35 is removed, permitting the drive end 20 and the collar 31 to be pulled out of the tool.

Figure 6:
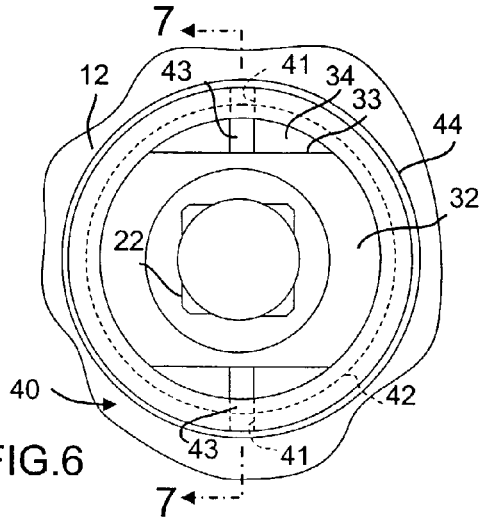
FIG. 6 is a view similar to FIG. 4 showing an alternate form of retaining structure.
Figure 7:
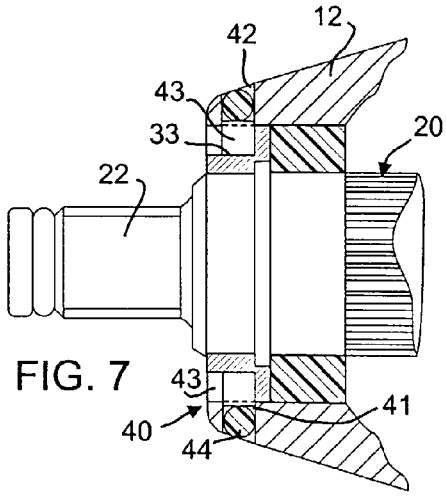
FIG. 7 is a fragmentary view similar to FIG. 1 of the retaining structure of FIG. 6.

Referring to FIGS. 6 and 7, there is illustrated an alternative embodiment of retaining structure, generally designated by the numeral 40. In this case, instead of parallel bores receiving a clip, there are formed in the housing 12, adjacent to the front end thereof, two diametrically aligned apertures in the form of radial bores 41. Also formed in the outer surface of the housing 12 and communicating with the bores 41 is an annular groove 42. Cylindrical retaining pins 43 are respectively inserted in the radial bores 41 to respectively seat on the flats 33 of the collar 31, each pin 43 having a length such that, when seated on the flat 33, it extends upwardly into the associated bore 41, the pins 43 being retained in place by an O-ring 44 seated in the groove 42. In order to remove the detachable drive end 20, the O-ring 44 is removed and the pins 53 are dropped out of the radial bores 41, whereupon the drive end 20 can be grasped and pulled out along with the collar 31.

Figure 8:
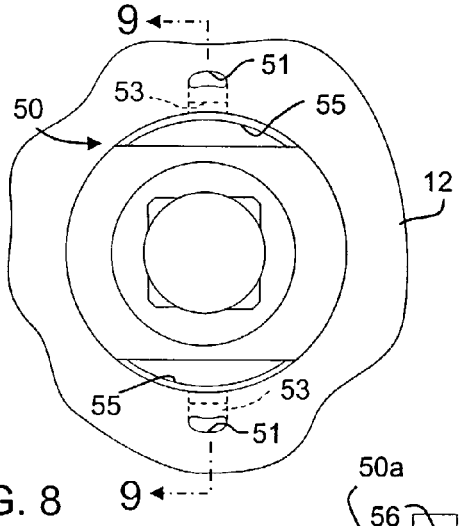
FIG. 8 is a view similar to FIG. 6 of another form of retaining structure.
Figure 9:
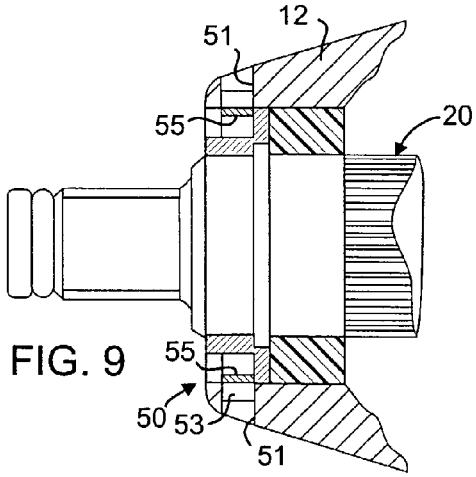
FIG. 9 is a view similar to FIG. 7 showing the retaining structure of FIG. 8.
Figure 11A:
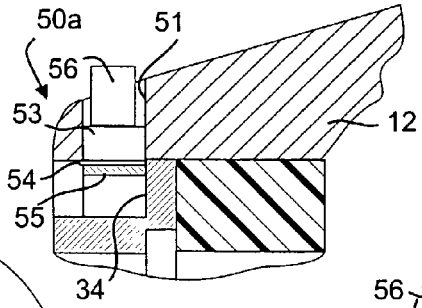
FIG. 11A is an enlargement of a portion of FIG. 11.
Figure 10:
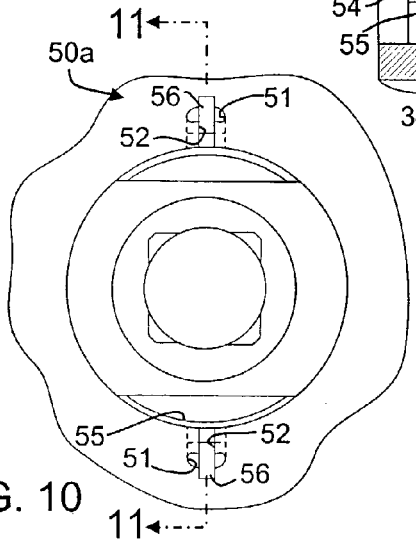
FIG. 10 is a view similar to FIG. 6 of another form of retaining structure.
Figure 11:
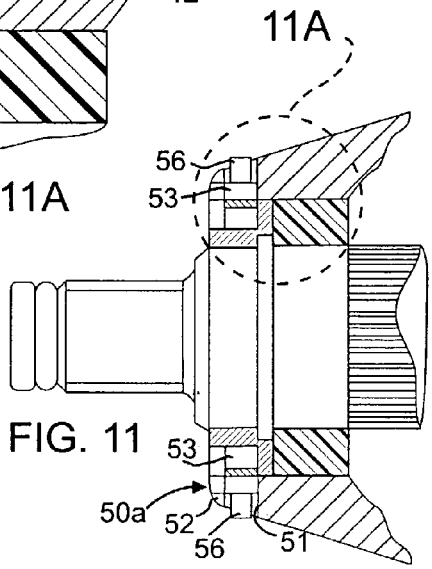
FIG. 11 is a view similar to FIG. 7 of the retaining structure of FIG. 10.

Referring to FIGS. 8 and 9, there is illustrated another embodiment of retaining structure, generally designated by the numeral 50. In this case, diametrically aligned bores 51 are formed in the housing 12 for respectively receiving pins 53. The pins 53 are respectively biased radially outwardly into the bores 51 by leaf springs 55, respectively disposed in front of the collar shoulders 34, with the opposite ends of each, spring 55 respectively bearing against the ends of the associated collar flat 33. A similar retaining structure, generally designated 50*a*, is shown in FIGS. 10 and 11, the basic difference being that each pin 53 is provided with a radially outwardly projecting extension 56. Referring to FIG. 11A, the pins 53 in both of the retaining structures 50 and 50*a* may be provided with a laterally outwardly projecting flange 54, which has a diameter greater than that of the radial bore 51 to prevent the pin 53 from escaping radially outwardly through the bore 51. These flanges 54 bear against the shoulder 34 of the collar 31 to retain them in place. Alternatively, the pins 53 could be fixed to the leaf springs 55.

In order to remove the detachable drive end 20, using the retaining structure 50 of FIGS. 8 and 9, a suitable tool may be inserted in the radial bores 51 to depress the pins 53 against the urging of the leaf springs 55 until the pins 53 clear the inner ends of the bores 51, whereupon the drive end 20 can be withdrawn. In the embodiment of FIGS. 10 and 11, no tool is needed. The extensions 56 have a length such as to project outwardly of the outer surface of the housing 12, so that they can be manually depressed with the user's fingers to disengage the pins 53. In this case, narrow notches 52 are formed in the front end of the housing 12 communicating with the bores 51 to permit passage of the pin extensions 56 when the drive end 20 is removed.

Figure 12:
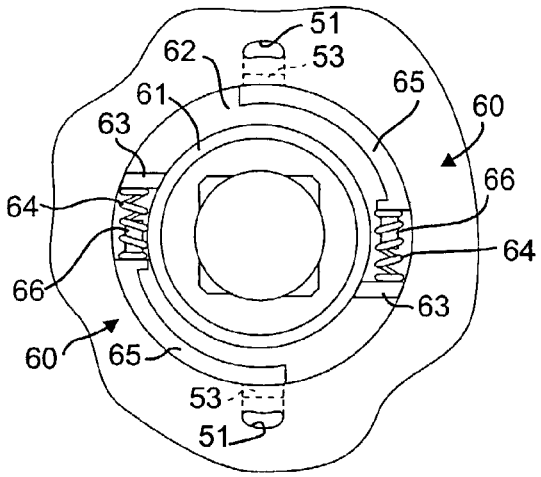
FIG. 12 is a view similar to FIG. 6 of another form of retaining structure and drive end mechanism.
Figure 13:
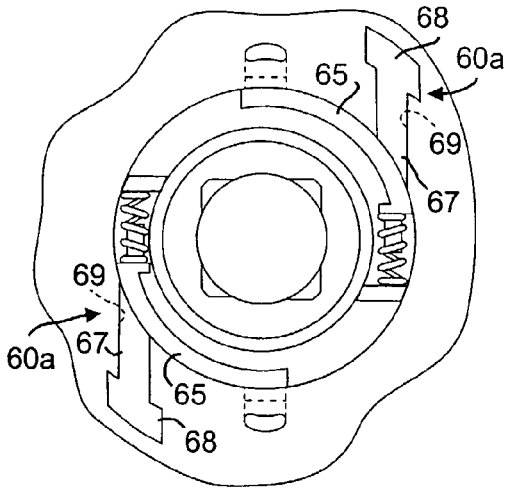
FIG. 13 is a view similar to FIG. 12 of another form of retaining structure.

Referring to FIG. 12, there is shown another alternate form of retaining structure, designated 60, which utilizes the same pins 53 described above in connection with FIGS. 8 and 9. However, in this case the drive end mechanism includes a modified cylindrical collar 61 having a radially outwardly extending annular flange 62 at its rear end. Laterally extending ledges 63 join the outer surface of the collar 61 to the front surface of the flange 62. Seated on the ledges 63 are helical compression springs 64, which respectively resiliently bias brackets 65 outwardly. In particular, each bracket 65 has a lug 66 extending into the associated spring 64 and frictionally secured thereto. The lengths of the brackets 65 are such as to engage the inner ends of the pins 53 for holding them in the bores 51. Suitable tools can be used to depress the pins 53 and the brackets 65 against the urging of the springs 64 to release the drive end mechanism. A similar retaining structure, designated 60*a*, is shown in FIG. 13, the difference being that each bracket 65 is provided with an extension 67 projecting outwardly through a suitable opening 69 in the housing 12 and having a head 68 for manually depressing the bracket 65 with the user's fingers. Slots (not shown) in the front end of the housing 12 may communicate with the openings 69 to facilitate removal of the retaining structure 60*a* with the drive end 20, similar to the arrangement described above with respect to FIGS. 10 and 11. In both of the embodiments of FIGS. 12 and 13 the pins 53 could be connected to the brackets 65.

Figure 14:
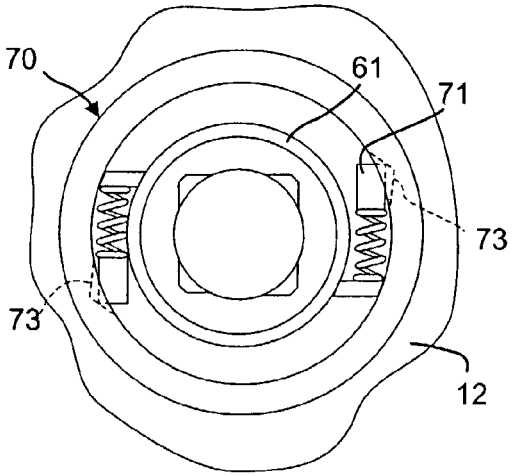
FIG. 14 is a view similar to FIG. 12 of another form of retaining structure in a retaining condition.
Figure 15:
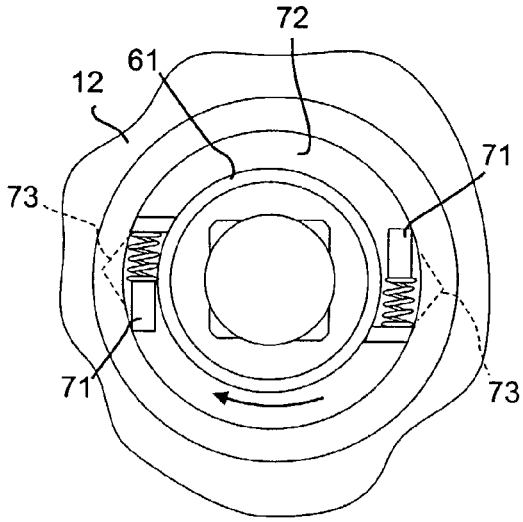
FIG. 15 is a view similar to FIG. 14 showing the retaining structure in a release condition.
Figure 16:
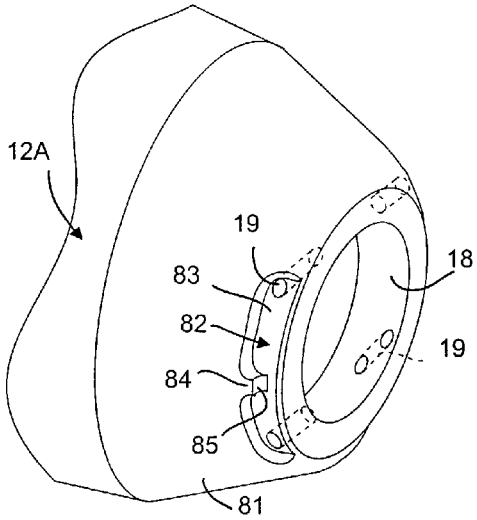
FIG. 16 is an enlarged, fragmentary, front perspective view of a modified form of housing of the tool of FIG. 1.

Another embodiment of retaining structure, designated 70, is shown in FIGS. 14 and 15, which utilizes the collar 61 of FIGS. 12 and 13. In this case, the housing structure 11 includes a rotatable ring 72 mounted on the end of the housing 12. The springs 64 bias pins 71 into engagement with the inner surface of the ring 72. The pins 71 seat in tapered notches 73 on the inner surface of the ring 70 in a locked position shown in FIG. 14 to hold the drive end 20 in place. To remove the drive end 20, the ring 70 is rotated in the direction of the arrow in FIG. 15, the notches 73 cammingly depressing the pins 71, so that they can ride up out of the notches to free the drive end 20.

Referring now to FIGS. 16–21, there is illustrated an alternative retaining arrangement, wherein the power tool has a modified housing 12A. The housing 12A is similar to the housing 12, described above, except that its frustoconical outer surface 81 is provided along one side thereof, at the front end thereof, with an elongated, generally oval-shaped recess 82, defining a generally part-cylindrical inner surface 83 in which the bores 19 are formed. Projecting forwardly from the axially rear end of the recess 82 is a holding lug 84, provided at its forward end with a concave seat surface 85. In this embodiment, there is provided a modified retaining clip 90, which is similar to the retaining clip 35, described above, having a bight 91 and a pair of legs 92 and 93. In the normal rest condition of the clip 90, the legs 92 and 93 converge slightly toward their distal ends (see FIG. 21).

Figure 17:
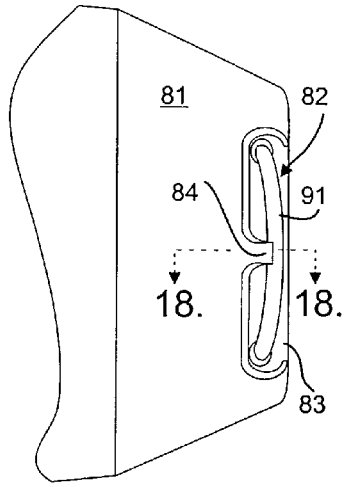
FIG. 17 is a fragmentary, side elevational view of the housing of FIG. 16 with a retaining clip in place therein.
Figure 18:
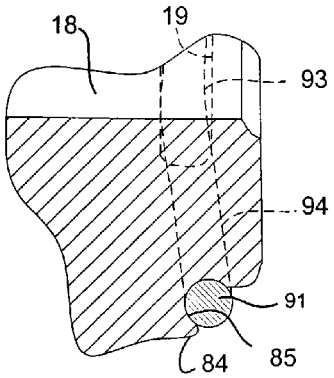
FIG. 18 is an enlarged, fragmentary, sectional view taken generally along line 18—18 in FIG. 17.
Figure 19:
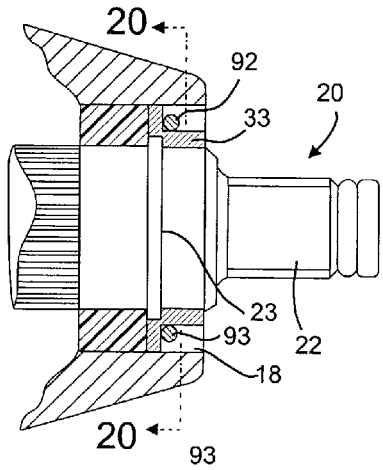
FIG. 19 is a reduced, fragmentary, sectional view of a rotary impact tool like that of FIG. 1, utilizing the housing and retaining clip of FIG. 17.
Figure 20:
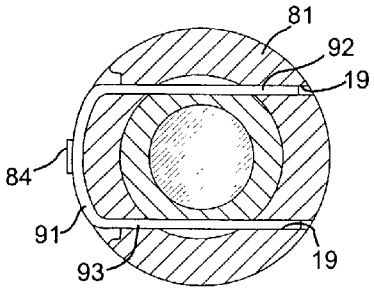
FIG. 20 is a sectional view taken generally along line 20—20 in FIG. 19.
Figure 21:
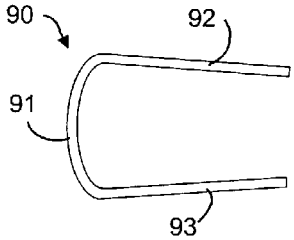
FIG. 21 is a top plan view of the retaining clip of FIGS. 17–20.

In operation, this retaining arrangement works in substantially the same manner as that described above in connection with FIGS. 1–5, the legs 92 and 93 of the clip 90 being spread sufficiently to permit them to be inserted in the bores 19 at the recess 82. It will be noted that the lug 84 interferes with insertion of the legs 92 and 93 coaxially into the bores 19, but the bores 19 have a slightly larger diameter than the legs 92 and 93 to permit insertion of the legs 92 and 93 up to a certain point, at which point the clip 90 must be bent or flexed slightly to permit full insertion until the bight 91 is disposed substantially against the inner surface 83 and seats on the concave seat surface 85, as shown in FIGS. 17 and 18. Thus, when the clip 90 is installed in place, it has a flexed or deflected portion 94 which causes the legs 92 and 93 to frictionally engage the ends of the inner surfaces of the bores 19 closest to the inner surface 83, frictionally holding the clip 90 in place.

In order to remove the drive end 20, the bight 91 of the clip 90 must be snapped up off the concave seat surface 85 to permit removal of the clip 90. This may be facilitated with a use of an appropriate tool.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A power tool comprising:

a housing structure having a cavity therein;

a drive mechanism disposed within the housing structure;

a detachable drive end mechanism, receivable in the cavity in a drive condition, in which condition the drive end mechanism is coupled to the drive mechanism;

a retaining structure disposable in a retaining condition engageable with the drive end mechanism for removably retaining it in the cavity; and capture structure engageable with the retaining structure in its retaining condition for cooperation therewith and with the housing structure for holding the retaining structure in its retaining condition, wherein the capture structure includes a lug and the retaining structure includes a flexible and resilient member which is flexed in its retaining condition for engagement with the lug and for frictional engagement with the housing structure.

2. The power tool of claim 1, wherein the capture structure is integral with the housing structure.

3. The power tool of claim 2, wherein the housing structure has an aperture therein, the retaining structure being disposable in the aperture in its retaining condition.

4. The power tool of claim 3, wherein the housing structure has two apertures therein and the detachable drive end mechanism has two flats, the retaining structure being a U-shaped retaining clip having two leg members respectively receivable in the apertures and engageable with the flats and a bight portion receivable in the recess and engageable with the lug.

5. The power tool of claim 1, wherein the drive end mechanism includes a collar, the retaining structure being engageable with the collar.

6. The power tool of claim 1, wherein the housing structure has two apertures therein, the retaining structure is a U-shaped retaining clip having two leg members, and the drive end mechanism includes a collar with diametrically opposed flats defining shoulders, each leg member removably insertable through an aperture and along a flat for engagement with a shoulder.

7. The power tool of claim 1, wherein the drive end mechanism has an annular flange therearound and the housing structure has a mechanical stop, the annular flange releasably engaging the mechanical stop when the drive end mechanism is in its drive condition.

8. The power tool of claim 1, and further comprising a bearing mounted within the housing structure, and a splined sleeve rotatably disposed within the bearing, the drive mechanism including an impact mechanism having a splined and received in the splined sleeve.

9. A power tool comprising:

a housing structure having a cavity therein, wherein said cavity includes an aperture;

a drive mechanism disposed within the housing structure;

a detachable drive end mechanism including at least one flat, a drive end and a collar encircling the drive end, said drive end mechanism receivable in the cavity in a drive condition, in which condition the drive end mechanism is coupled to the drive mechanism; and a retaining structure removably receivable in the cavity for engagement with the flat of the drive end mechanism to retain the drive end mechanism in its drive condition, wherein the retaining structure is removably insertable in the aperture for engaging the collar.

10. The power tool of claim 9, wherein the housing structure has two apertures therein, the drive end mechanism has two flats, and the retaining structure including portions respectively removably insertable in the apertures for engagement with the flats.

11. The power tool of claim 9, wherein the retaining structure includes a U-shaped retaining clip having two leg members, the housing structure having two apertures therein, and wherein the collar has diametrically opposed flats defining shoulders, each leg member removably insertable through an aperture across a flat for engaging the associated shoulder.

12. The power tool of claim 9, wherein the drive end mechanism has an annular flange therearound and the housing has a mechanical stop, the annular flange releasably engaging the mechanical stop when the drive end mechanism is in its drive condition.

13. The power tool of claim 9, wherein the drive end mechanism has two end portions and a middle portion with a greater cross-sectional diameter than either end portion.

14. The power tool of claim 9, and further comprising a splined sleeve rotatively coupling the drive mechanism to the drive end mechanism.

15. The power tool of claim 14, wherein the drive mechanism includes an impact mechanism and has a splined end received in the splined sleeve.

16. The power tool of claim 15, wherein the drive end mechanism has a splined end received in the splined sleeve.

17. The power tool of claim 16, and further comprising a bearing mounted within the housing, the splined sleeve being rotatably disposed within the bearing.

18. A power tool comprising:

a housing structure having a mechanical stop and a cavity therein;

a drive mechanism disposed within the housing structure;

a detachable drive end mechanism including at least one flat and an annular flange therearound, said drive end mechanism receivable in the cavity in a drive condition, in which condition the drive end mechanism is coupled to the drive mechanism, said annular flange being releasably engagable with the mechanical stop when the drive end mechanism is in its drive condition; and a retaining structure removably receivable in the cavity for engagement with the flat of the drive end mechanism to retain the drive end mechanism in its drive condition.

19. The power tool of claim 18, wherein the cavity includes an aperture.

20. The power tool of claim 19, wherein the housing structure has two apertures therein, the detachable drive end mechanism has two flats, and the retaining structure including portions respectively removably insertable in the apertures for engagement with the flats.

21. The power tool of claim 19, wherein the drive end mechanism includes a drive end and a collar encircling the drive end, the retaining structure being removably insertable in the aperture for engaging the collar.

22. The power tool of claim 21, wherein the retaining structure includes a U-shaped retaining clip having two leg members, the housing structure having two apertures therein, and wherein the collar has diametrically opposed flats defining shoulders, each leg member removably insertable through an aperture across a flat for engaging the associated shoulder.

23. The power tool of claim 18, wherein the drive end mechanism has two end portions and a middle portion with a greater cross-sectional diameter than either end portion.

24. The power tool of claim 18, and further comprising a splined sleeve rotatively coupling the drive mechanism to the detachable drive end mechanism.

25. The power tool of claim 24, wherein the drive mechanism includes an impact mechanism and has a splined end received in the splined sleeve.

26. The power tool of claim 25, wherein the detachable drive end mechanism has a splined end received in the splined sleeve.

27. The power tool of claim 26, and further comprising a bearing mounted within the housing, the splined sleeve being rotatably disposed within the bearing.

28. A power tool comprising:

a housing structure having a cavity and two apertures therein, a drive mechanism disposed within the housing structure;

a detachable drive end mechanism including two flats, receivable in the cavity in a drive condition, in which condition the drive end mechanism is coupled to the drive mechanism; and a retaining structure including portions respectively removably insertable in the apertures for engagement with the flats of the drive end mechanism to retain the drive end mechanism in its drive condition.

* * * * *